US010167656B2

(12) United States Patent
Park et al.

(10) Patent No.: US 10,167,656 B2
(45) Date of Patent: Jan. 1, 2019

(54) RETRACTABLE HANDLE SYSTEM FOR VEHICLE

(71) Applicant: Hyundai Motor Company, Seoul (KR)

(72) Inventors: Hoo Sang Park, Hwaseong-si (KR); Jung Ho Han, Seoul (KR)

(73) Assignee: Hyundai Motor Company, Seoul (KR)

( * ) Notice: Subject to any disclaimer, the term of this patent is extended or adjusted under 35 U.S.C. 154(b) by 557 days.

(21) Appl. No.: 14/925,843

(22) Filed: Oct. 28, 2015

(65) Prior Publication Data

US 2016/0281397 A1 Sep. 29, 2016

(30) Foreign Application Priority Data

Mar. 24, 2015 (KR) ..... 10-2015-0040955

(51) Int. Cl.

| | |
|---|---|
| ***E05B 85/10*** | (2014.01) |
| ***E05B 81/06*** | (2014.01) |
| ***E05B 81/36*** | (2014.01) |
| ***E05B 81/42*** | (2014.01) |

(52) U.S. Cl.

CPC ..... *E05B 85/107* (2013.01); *E05B 81/06* (2013.01); *E05B 81/36* (2013.01); *E05B 81/42* (2013.01); *E05B 85/103* (2013.01)

(58) Field of Classification Search

CPC ..... E05B 85/107; E05B 81/06; E05B 81/34; E05B 79/06; E05B 5/003; E05B 5/00; Y10T 70/5761; Y10T 292/1082; Y10S 292/31

See application file for complete search history.

(56) References Cited

U.S. PATENT DOCUMENTS 8,701,353 B2 * 4/2014 Patel ..... E05B 81/34 292/144
8,919,047 B2 * 12/2014 Johnsrud ..... E05B 85/103 292/336.3
9,249,608 B2 * 2/2016 Lang ..... E05B 85/103

(Continued)

FOREIGN PATENT DOCUMENTS

CN 103132784 A 6/2013
JP 2009-74275 A 4/2009

(Continued)

OTHER PUBLICATIONS

Luscious Garage, Tesla Model S door handle; posted Aug. 5, 2012; Retrieved from the Internet: http://www.youtube.com/watch?v=0ji92dFHLhA.

*Primary Examiner* — Mark A Williams
(74) *Attorney, Agent, or Firm* — Morgan, Lewis & Bockius LLP

(57) ABSTRACT

A retractable handle system for a vehicle may include an electric actuator disposed inside a door panel, a driving member configured to be rotated in forward and reverse directions by receiving rotational force of the electric actuator, a driving arm provided to be rotated in the forward and reverse directions by the rotation of the driving member and blocked by the driving member from being rotated in a state in which an operation of the electric actuator is stopped so as to maintain a stored state and a pop-up state of a handle, and the handle which is supported by and coupled to the driving arm and configured to be moved by the forward and reverse rotation of the driving arm.

13 Claims, 13 Drawing Sheets

[STORED STATE(DOOR LOCKED STATE)]

[POP-UP STATE(DOOR UNLOCKED STATE)]

(56) References Cited

U.S. PATENT DOCUMENTS

| | | | | |
|---|---|---|---|---|
| 2003/0019261 | A1* | 1/2003 | Wittwer | E05B 85/107 70/257 |
| 2011/0148575 | A1* | 6/2011 | Sobecki | E05B 85/107 340/5.64 |
| 2012/0128344 | A1* | 5/2012 | Kwon | E05B 81/06 396/429 |
| 2013/0076047 | A1 | 3/2013 | Wheeler et al. | |
| 2013/0076048 | A1* | 3/2013 | Aerts | E05B 85/103 292/336.3 |
| 2013/0127185 | A1* | 5/2013 | Lang | E05B 81/77 292/336.3 |
| 2013/0241215 | A1* | 9/2013 | Halliwell | E05B 85/107 292/336.3 |
| 2014/0265372 | A1* | 9/2014 | Smart | E05B 85/103 292/336.3 |
| 2015/0233154 | A1* | 8/2015 | Smart | E05B 85/103 70/237 |

FOREIGN PATENT DOCUMENTS

| | | | |
|---|---|---|---|
| JP | 2010-248901 | A | 11/2010 |
| KR | 20-0230352 | Y1 | 7/2001 |
| KR | 20-0359913 | Y1 | 8/2004 |
| KR | 10-0685113 | B1 | 2/2007 |
| KR | 10-0694416 | B1 | 3/2007 |
| KR | 10-2012-0053914 | A | 5/2012 |
| KR | 10-1334210 | B1 | 11/2013 |

* cited by examiner

[STORED STATE(DOOR LOCKED STATE)]

[POP-UP STATE(DOOR UNLOCKED STATE)]

[PULLING STATE(DOOR IS OPEN)]

[STORED STATE(DOOR LOCKED STATE)]

[POP-UP STATE(DOOR UNLOCKED STATE)]

[PULLING STATE(DOOR IS OPEN)]

[STORED STATE(DOOR LOCKED STATE)]

[POP-UP STATE(DOOR UNLOCKED STATE)]

[PULLING STATE(DOOR IS OPEN)]

RETRACTABLE HANDLE SYSTEM FOR VEHICLE

CROSS-REFERENCE TO RELATED APPLICATION

The present application claims priority to Korean Patent Application No. 10-2015-0040955 filed Mar. 24, 2015, the entire contents of which is incorporated herein for all purposes by this reference.

BACKGROUND OF THE INVENTION

Field of the Invention

The present invention relates to a retractable handle system for a vehicle, and more particularly, to a retractable handle system for a vehicle, in which functions of locking and unlocking a door may be implemented by pop-up/retracting operation of a handle such that an actuator of a door latch may be eliminated, thereby reducing the number of components, costs and weights.

Description of Related Art

A door latch which performs operations of locking, unlocking and opening a door, an inside handle and an outside handle which serve to open the door, a door locking mechanism which enables operations of locking and unlocking the door by using a key, a safety knob which maintains a door locked state, and the like are provided inside and outside a vehicle door.

In general, when a driver inserts a vehicle key into a key cylinder (reference number 4 in FIG. 2) of the door locking mechanism and rotates the key, rotational force of the key is transmitted to the door latch through a mechanical connecting structure, thereby locking and unlocking the door.

Otherwise, the operations of locking and unlocking the door may be carried out by manipulating a button of a remote control (fob key). In the case a vehicle to which a personal identification card (PIC) system is applied, when a driver having a smart key approaches the vehicle, the door is unlocked by the door latch, such that the driver may immediately open the door.

Otherwise, the driver having the smart key pushes the button of the outside handle to unlock the door, and then pulls the outside handle to open the door.

In addition, when the outside handle is manipulated in a state in which the door is unlocked by the door latch, that is, in a door unlocked state, operating force of the handle is transmitted through a cable (or rod) which is connected between the outside handle and the door latch, and the door latch performs an operation of opening the door (operation of releasing a striker installed in a vehicle body), such that a user may open the door.

In this case, when the user manipulates the outside handle in the door unlocked state of the door latch, operating force is transmitted to the door latch by the cable (or rod), and as a result, the door latch performs the operation of opening the door by using the operating force.

Because the mechanical connecting structure between the outside handle and the door latch, which opens the door in the door unlocked state, is a publicly known technology, a description thereof will be omitted.

Meanwhile, in a case in which an electric retractable handle is applied as the outside handle, a motor, which rotates the handle, is provided, and the motor at the handle side allows the handle to protrude toward the outside of the door panel so that the handle may be manipulated only when the door is opened, or allows the handle to be retracted into the door panel so that the handle does not protrude when the handle is not used, and at normal times, the motor positions the handle so that the handle does not protrude from the door panel.

In contrast, when the remote control is manipulated to unlock the door or when the driver having the smart key approaches the vehicle, the motor is operated to rotate the handle and allow the handle to protrude toward the outside of the door panel so that the handle may be pulled.

FIG. 1A and FIG. 1B are views illustrating an electric retractable handle, in which FIG. 1A illustrates a stored state in which a handle 2 is retracted into a door panel 1 so as not to protrude toward the outside, and FIG. 1B illustrates a state in which the handle 2 protrudes toward the outside of the door panel 1 so that the handle 2 may be pulled.

As illustrated, the handle 2 is stored inside a mounting portion of the door panel 1 and does not protrude from a surface of the door panel, and thereafter, the handle 2 is rotated by a non-illustrated inner motor 3 and protrudes toward the outside of the door panel 1 so that the driver may manipulate the handle.

FIG. 2A and FIG. 2B are schematic views illustrating an electric retractable handle and a door latch, which illustrate a state in which the handle 2 is stored by the motor 3 and a state in which the handle 2 protrudes by the motor 3, in which FIG. 2A illustrates a state in which the handle 2 is stored so as not to protrude toward the outside, and FIG. 2B illustrates a state in which the motor 3 is operated to allow the handle 2 to protrude toward the outside so that the handle 2 may be pulled.

In the present specification, the state in which the handle protrudes so that the handle may be pulled as illustrated in FIG. 2B is referred to as a pop-up state.

Even in a case in which the electric retractable handle is applied, when a driver inserts a vehicle key into a key cylinder (reference number 4*a* in FIG. 1) of a door locking mechanism 3 and rotates the key, rotational force of the key may be transmitted to the door latch 5, thereby locking and unlocking the door.

In addition, when a button of a remote control (not illustrated) is manipulated or when the driver having the smart key approaches the vehicle, the operations of locking and unlocking the door may be performed by an electric actuator 6 including the motor in the door latch 5, and in this case, because the door latch has its own actuator 6, the operations of locking and unlocking the door may be carried out independently of the pop-up operation of the handle.

However, the handle 2 and the door latch 5 are mechanically connected by a cable 7, and the cable 7 is used to open the door.

That is, when the handle pops up by the motor 3 at the handle 2 side, and then the user pulls the handle in the door unlocked state, operating force of the handle is transmitted to the door latch 5 through the cable 7, and as a result, the door latch 5 connected with the cable 7 is operated, thereby opening the door.

As described above, in the vehicle to which the electric retractable handle in the related art is applied, the motor 3, which serves to operate the handle, and the actuator 6, which serves to lock and unlock the door, are provided separately from each other, and as a result, there are problems in that the number of components is excessive, and costs and weights are increased.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a retractable handle system for a vehicle, in which functions of locking and unlocking a door may be implemented by pop-up and retracting operations of a handle, and as a result, it is possible to eliminate a separate actuator in a door latch which performs an operation of locking and unlocking the door, thereby reducing the number of components, costs and weights.

According to various aspects of the present invention, a retractable handle system for a vehicle may include an electric actuator disposed inside a door panel, a driving member configured to be rotated in forward and reverse directions by receiving rotational force of the electric actuator, a driving arm provided to be rotated in the forward and reverse directions by the rotation of the driving member and blocked by the driving member from being rotated in a state in which an operation of the electric actuator is stopped so as to maintain a stored state and a pop-up state of a handle, and the handle which is supported by and coupled to the driving arm and configured to be moved by the forward and reverse rotation of the driving arm so as to be placed in the stored state in which the handle is retracted into the door panel in order to lock a door, or in the pop-up state in which the handle protrudes toward an outside of the door panel in order to enable an operation of opening the door.

The electric actuator may include rotation prevention mechanism that prevents the driving member from rotating when the operation of the electric actuator is stopped in the handle stored state.

The electric actuator may include a case, a motor which is mounted in the case, and a gear device to transmit rotational force of the motor to the driving member.

The electric actuator may include a gear device that serves as a rotation prevention mechanism which prevents the driving member from rotating when the operation of the electric actuator is stopped in the handle stored state, the gear device including a worm gear which is disposed on a driving shaft of the motor, and a rotary gear which is rotatably and integrally coupled to the driving member and engages, in the form of a worm wheel, with the worm gear.

Two driving arms may be provided, one on each of left and right sides so as to support the handle at both of the left and right sides, a first end of each of the driving arms may be coupled to the handle, and a second end of each of the driving arms may be coupled to the driving member so as to be operated in conjunction with the driving member.

The electric actuator, the driving member, the driving arms, and the handle may be disposed in a housing that is fixedly mounted inside the door panel, a hinge shaft may be connected between the second ends of the two driving arms at both left and right sides, and both ends of the hinge shaft may be rotatably coupled to the housing in a state in which the hinge shaft penetrates a rotation center of the driving member.

An end of at least one of the two driving arms is coupled to be positioned inside the driving member, and the driving member may include a first pushing portion configured to push the driving arm positioned inside the driving member when the driving member is rotated in a direction in which the handle pops up, and a second pushing portion configured to push the driving arm positioned inside the driving member when the driving member is rotated in a direction in which the handle is stored.

An interval may be formed between the first pushing portion and the second pushing portion, where the end of the driving arm is positioned, so that the driving arm being in contact with the first pushing portion may be rotated toward the second pushing portion in order to allow the handle to be additionally pulled to open the door in the pop-up state in which the handle protrudes from a surface of the door panel.

The electric actuator, the driving member, the driving arm, and the handle may be disposed in a housing that is fixedly mounted inside the door panel, and as a guide device that allows the handle to be guided in the housing along an operation trajectory, a protrusion, which protrudes from the handle, and a guide groove, which is formed in the housing to allow the protrusion to be inserted into and guided by the guide groove, may be provided.

The retractable handle system may further include a support frame which is fixedly disposed inside the door panel, in which the driving arm may include a first driving arm and a second driving arm that are disposed at both left and right sides of the support frame, and a first end of each of the first driving arm and the second driving arm may be hingedly coupled to the handle, a second end may be coupled to a guide hole of the support frame through a protrusion.

The first driving arm and the second driving arm may be configured to be rotated about the protrusions that are moved and guided along the guide holes of the support frame, and rotated to be deployed and protrude toward the outside of the support frame and the door panel so as to push the handle when the handle pops up.

A spring member, which provides elastic restoring force for rotating each of the first driving arm and the second driving arm with respect to the handle so that each of the first driving arm and the second driving arm is retracted into the support frame when the handle is stored, may be disposed between the first end of each of the first driving arm and the second driving arm and the handle.

The electric actuator may include a motor, a gear device which transmits rotational force of the motor, and a driving shaft connected to the driving members to transmit rotational force of the motor, which is output from the gear device, to the driving members.

The driving members may include a first driving member and a second driving member, and the first driving member and the second driving member may be formed to have hook shapes that hook the protrusions of the driving arms when the protrusions of the driving arms are inserted into catching grooves, and catch the protrusions of the driving arms, respectively, in the handle stored state to restrict the corresponding driving arm and block the corresponding driving arm from being rotated so that the handle does not pop up.

Each of the first driving member and the second driving member may include a cam surface that is separated from the protrusion of one driving arm and configured to push the protrusion of another driving arm when the first driving member and the second driving member are rotated in a direction in which the handle pops up so as to allow the protrusion of the other driving arm to be moved along the guide hole of the support frame and rotate the other driving arm in the direction in which the handle pops up.

Accordingly, according to the retractable handle system for a vehicle of the present invention, functions of locking and unlocking the door may be implemented by pop-up and retracting operations of the handle, and as a result, it is possible to eliminate a separate actuator in a door latch which performs an operation of locking and unlocking the door, thereby reducing the number of components, costs and weight.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An object of the present invention is to provide a retractable handle system for a vehicle, in which functions of locking and unlocking a door may be implemented by pop-up and retracting operations of a handle such that an actuator of a door latch may be eliminated, thereby reducing the number of components, costs and weights.

The retractable handle system of the present invention includes an electric actuator which is disposed inside a door panel, a driving member is rotated in forward and reverse directions by receiving rotational force of the electric actuator, a driving arm which is provided to be rotated in the forward and reverse directions by the rotation of the driving member and blocked by the driving member from being rotated in a state in which an operation of the electric actuator is stopped so as to maintain a stored state and a pop-up state of a handle to be described below, and the handle which is supported by and coupled to the driving arm and moved by the forward and reverse rotation of the driving arm so as to be placed in the stored state in which the handle is retracted into the door panel in order to provide a function of locking a door, or in the pop-up state in which the handle protrudes toward the outside of the door panel in order to enable an operation of opening the door.

Figure 1A:
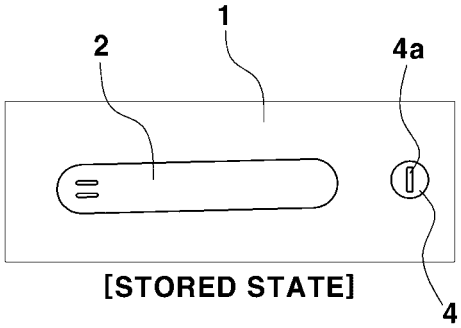
FIG. 1A (Related Art)
FIG. 1A and FIG. 1B are views illustrating an electric retractable handle according to the related art.
Figure 1B:
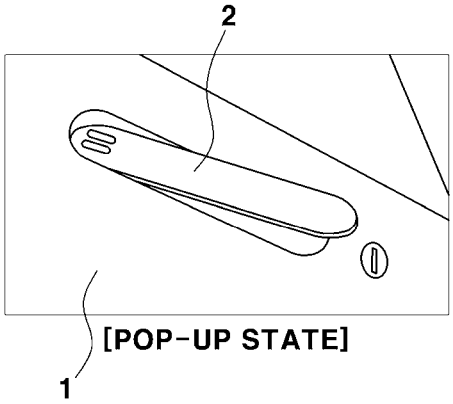
FIG. 1B (Related Art)
Figure 2A:
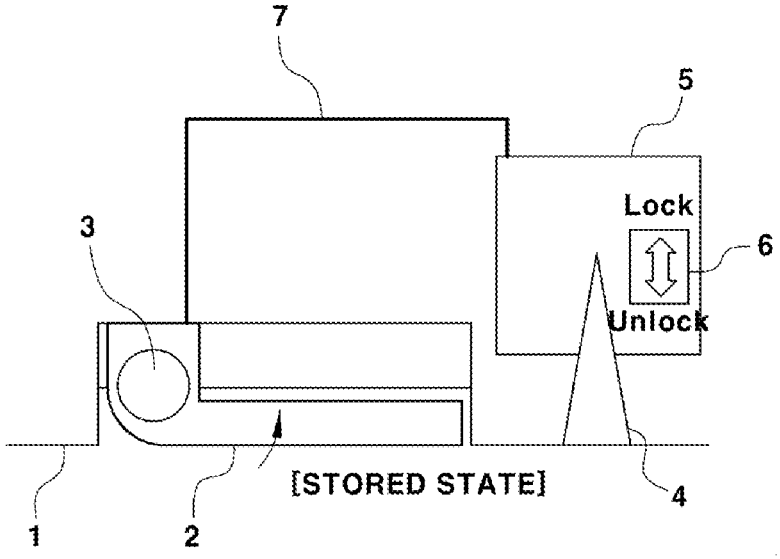
FIG. 2A (Related Art)
FIG. 2A and FIG. 2B are schematic views illustrating the electric retractable handle and a door latch according to the related art.
Figure 2B:
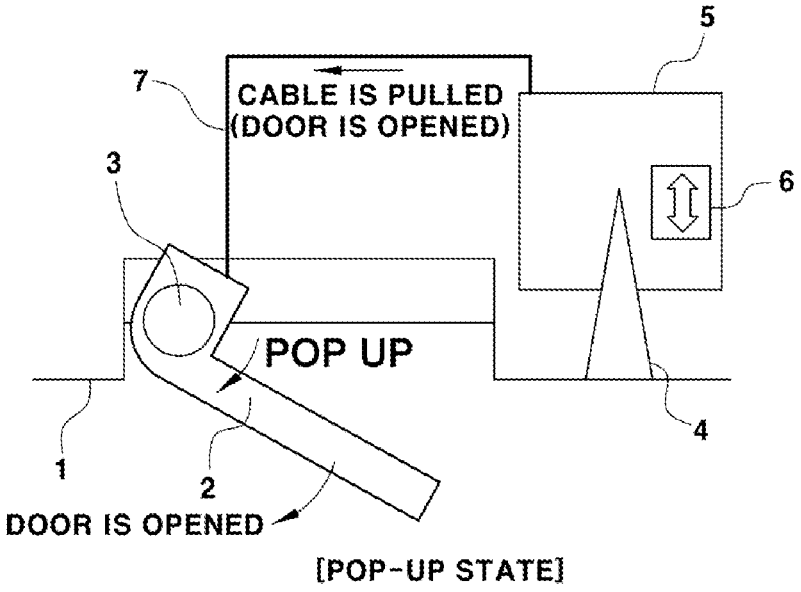
FIG. 2B (Related Art)
Figure 3:
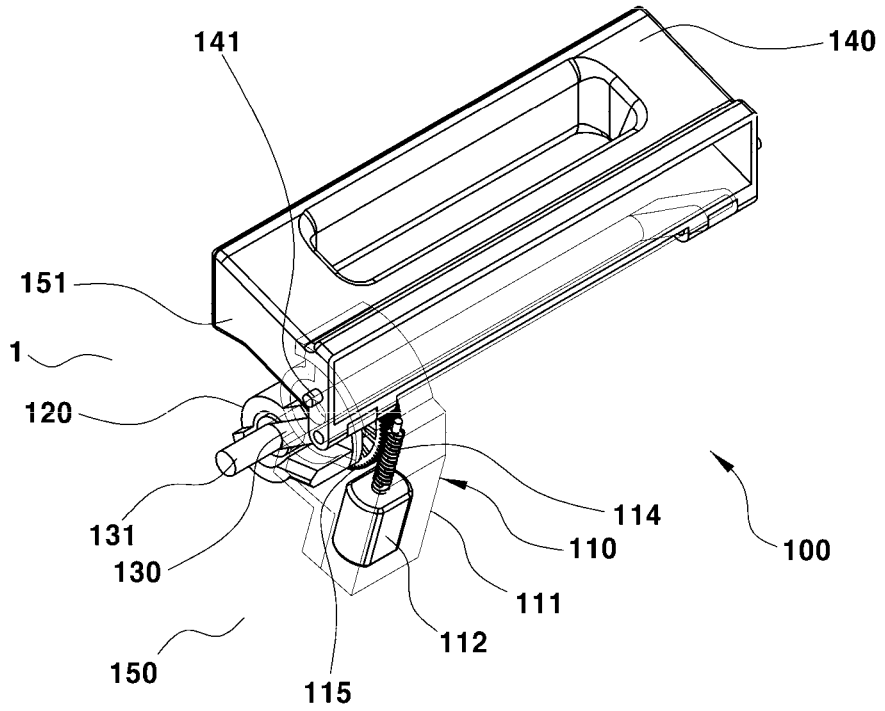
FIG. 3 is a perspective view illustrating an exemplary retractable handle system according to the present invention.
Figure 4A:
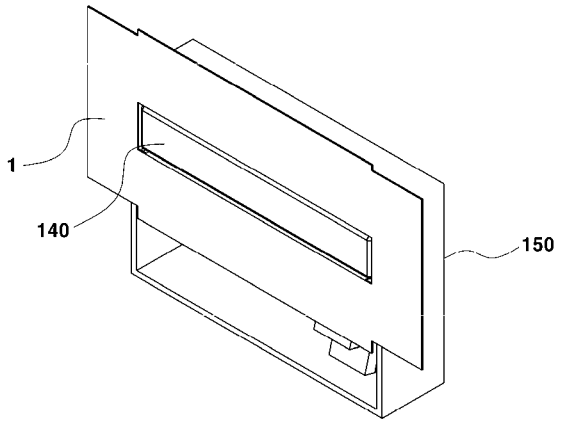
FIG. 4A, FIG. 4B, and FIG. 4C are perspective views illustrating a handle stored state, a handle pop-up state, a pulling state in the exemplary retractable handle system according to the present invention.
Figure 4B:
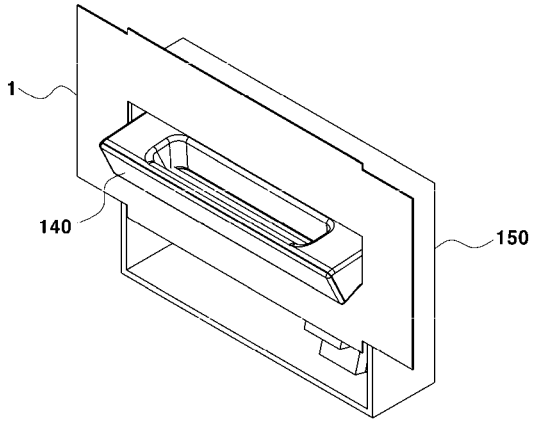
Figure 4C:
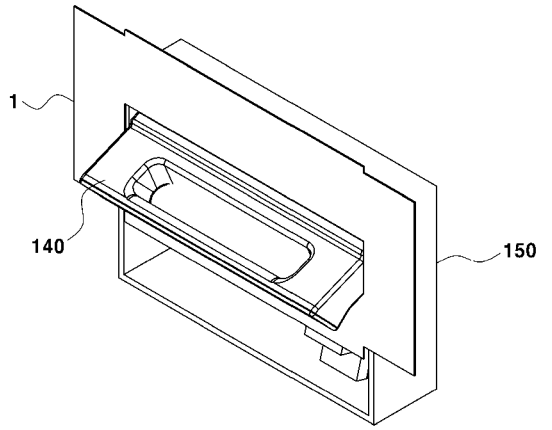

FIG. 3 is a perspective view illustrating a retractable handle system according to various embodiments of the present invention, and FIG. 4A, FIG. 4B, and FIG. 4C are perspective views illustrating a handle stored state, a handle pop-up state, a pulling state in the retractable handle system according to various embodiments of the present invention.

Figure 5:
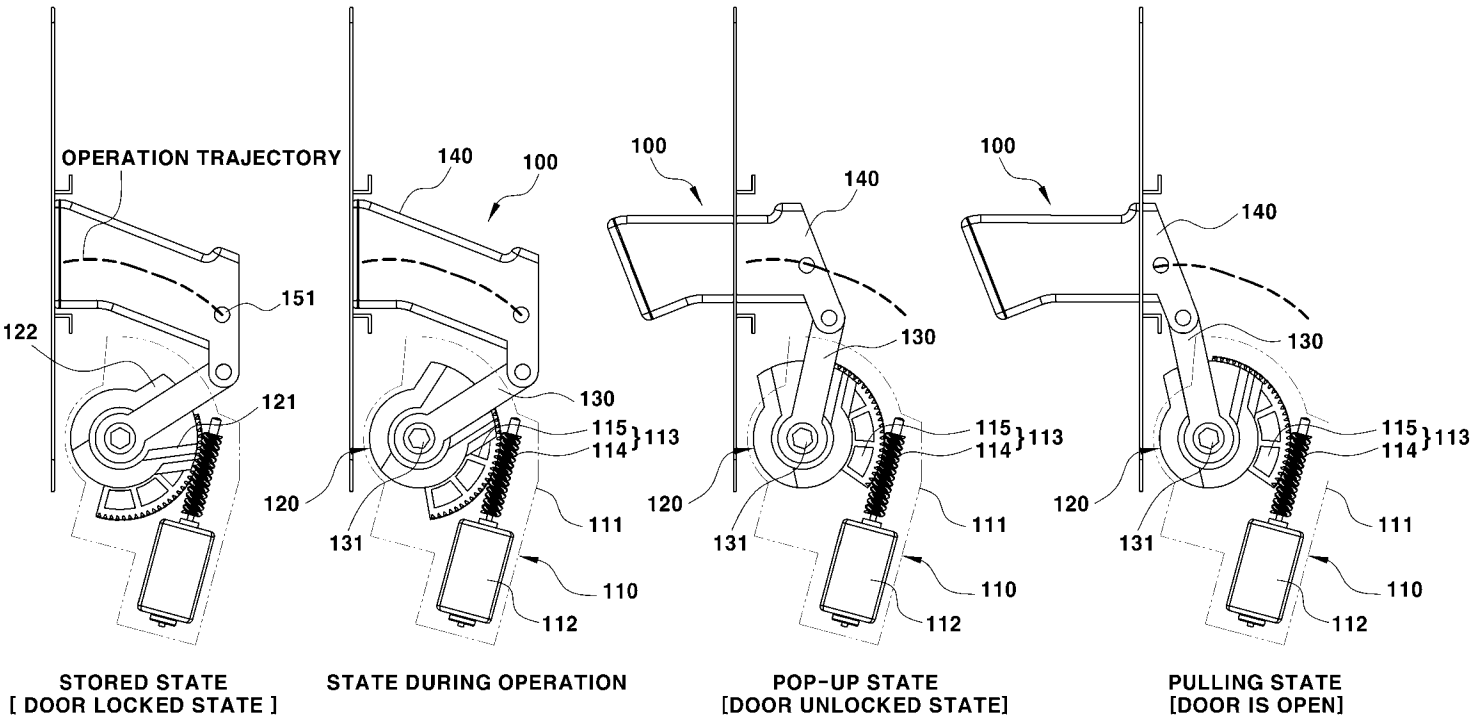
FIG. 5 is a view illustrating an operating state in which a handle of the retractable handle system according to the exemplary embodiment of the present invention pops up and is pulled from a state in which the handle is stored in a door panel.

In addition, FIG. 5 is a view illustrating an operating state in which the handle of the retractable handle system according to various embodiments of the present invention pops up by an operation of a motor and is pulled by a user from a state in which the handle is stored in a door panel.

First, a retractable handle system 100 according to various embodiments includes an electric actuator 110 which includes a motor 112 fixedly disposed inside a door panel 101, a driving member 120 which is rotated in forward and reverse directions by receiving rotational force of the electric actuator 110, a driving arm 130 which is coupled to the driving member 120 and rotated in the forward and reverse directions by the rotation of the driving member, and a handle 140 which is hingedly coupled to the driving arm 130 and moved by the forward and reverse rotation of the driving arm so as to be retracted and stored into the door panel 101, or to pop up while protruding toward the outside of the door panel.

As illustrated in FIG. 3, the electric actuator 110, the driving member 120, the driving arm 130, and the handle 140 may be mounted in a housing 150, and in this case, the housing 150 is fixedly mounted inside the door panel 101.

The electric actuator 110 includes a case 111 which is fixedly disposed in the housing 150, the motor 112 which is mounted in the case 111, and a gear device 113 which transmits rotational force of the motor 112 to the driving member 120. The gear device 113 includes a worm gear 114 which is disposed on a driving shaft of the motor 112, and a rotary gear 115 which is rotatably and integrally coupled to the driving member 120 and engages, in the form of a worm wheel, with the worm gear 114.

As described in various embodiments, in a case in which the gear device 113, which serves to transmit rotational force of the motor 112 to the driving member 120, includes the worm gear 114, and the rotary gear 115 formed in the form of a worm wheel, it is possible to prevent the driving arm 130 and the driving member 120 from being forcedly rotated by the handle 140, and to prevent the handle 140 from popping up forcedly due to external force from the outside of a vehicle.

That is, in various embodiments, the worm gear 114 is applied to the driving shaft of the motor 112 to prevent the handle 140 from being manually manipulated, and the handle 140 may be stored and may pop up only when the motor 112 is operated and the driving member 120 is rotated.

Therefore, in a state in which the handle 140 is stored so as not to protrude from a surface of the door panel 101, the handle cannot pop up arbitrarily and forcedly due to external force from the outside of the vehicle, and as a result, the handle 140 cannot be pulled, such that a function of locking a door may be naturally implemented when the handle is stored.

As described above, the electric actuator 110 has a rotation prevention mechanism that prevents the driving member 120 from rotating when an operation of the electric actuator is stopped in a state in which the handle is stored, and the rotation prevention mechanism may be implemented by the gear device 113 that includes the worm gear 114 which is disposed on the driving shaft of the motor 112, and the rotary gear 115 which is rotatably and integrally coupled to the driving member 120 and engages, in the form of a worm wheel, with the worm gear 114.

Accordingly, in a case in which the retractable handle system 100 of the present invention is applied, it is possible to eliminate a separate actuator that is provided in a door latch to lock/unlock the door.

The driving arm 130 has one end which is hingedly coupled to the handle 140, and the other end which is hingedly coupled to the driving member 120 by a hinge shaft 131, and in a state in which the hinge shaft 131 penetrates the rotary gear 115 of the gear device 113 and a rotation center of the driving member 120, both ends of the hinge shaft 131 are rotatably coupled to both lateral portions of the housing 150.

In this case, the driving arm 130 is a member that supports the handle 140 and moves the handle 140 by receiving rotational force of the motor 112. In the various embodiments, two driving arms 130 are provided, one on each of left and right sides so as to support the handle 140 at both of the left and right sides.

One end of each of the driving arms 130 is hingedly coupled to each of both left and right portions of the handle 140 (preferably, both ends of the handle 140) based on a longitudinal direction of the handle 140, and in this case, the other end of each of the driving arms 130 is integrally coupled to the hinge shaft 131.

Therefore, the hinge shaft 131 is a shaft that integrally connects the left and right driving arms 130, and the left and right driving arms 130, which are integrally connected by the hinge shaft 131, may be rotated in the same direction at the same time.

The driving member 120 is a member that controls and restricts a position of the driving arm 130, and rotates in the forward and reverse direction by receiving rotational force of the motor 112 through the gear device 113, and particularly, the driving member 120 is coupled to the driving arm 130 so that in accordance with the direction of the forward and reverse rotation, the driving member 120 pushes the driving arm 130 in a direction in which the handle pops up, or pulls the driving arm 130 in a direction in which the handle is stored.

As described above, the hinge shaft 131 of the driving arm 130 is coupled while penetrating the rotation center of the driving member 120, and any one of the two driving arms 130 is coupled to the driving member 120 so that an end of the driving arm 130 is positioned inside the driving member 120.

In addition, the driving member 120 has a first pushing portion 121 which pushes the driving arm 130 positioned inside the driving member 120 when the driving member 120 is rotated in a forward direction (the direction in which the handle pops up), for example, in a counterclockwise direction in FIG. 5, and a second pushing portion 122 which pushes the driving arm 130 when the driving member 120 is rotated in a reverse direction (the direction in which the handle is stored), for example, in a clockwise direction in FIG. 5.

In this case, the driving arm 130 is positioned between the first pushing portion 121 and the second pushing portion 122, and there is an interval between the first pushing portion 121 and the second pushing portion 122 so that the driving arm 130 may be rotated with clearance.

That is, the interval is formed between the first pushing portion 121 and the second pushing portion 122, where the end of the driving arm 130 is positioned, so that the driving arm 130 being in contact with the first pushing portion 121 may be rotated toward the second pushing portion 122 in order to enable the handle 140 to be additionally pulled to open the door in the pop-up state in which the handle 140 protrudes from the surface of the door panel 101.

The above configuration is to ensure a handle operation stroke for opening the door in the pop-up state of the handle 140.

Meanwhile, one side of the handle 140 is hingedly coupled to the end of the driving arm 130, and therefore, the driving arm 130 and the handle 140 form a link structure, such that when the driving arm 130 is rotated, the handle 140 may be moved in the direction in which the handle 140 pops up and in the direction in which the handle 140 is stored.

The handle 140 needs to be moved along a predetermined operation trajectory when the driving arm 130 is rotated in a state in which the handle 140 is supported by the driving arm 130, and as a result, a guide device 155, which guides the handle 140 along the operation trajectory, is provided between the housing 150 and the handle 140.

In the various embodiments, the guide device 155 includes protrusions 141 which protrude on both left and right end surfaces of the handle 140, and guide grooves 151 which are formed in both side surfaces of the housing 150 to allow the protrusions 141 to be inserted into and guided by the guide grooves 151.

The guide grooves 151 formed in the side surfaces of the housing 150 are elongated in a curved shape along the operation trajectory of the handle 140, and when the handle 140 is moved by the driving arm 130, the guide grooves 151 guides the protrusions 141, thereby positioning the handle 140.

In addition, a non-illustrated cable is connected between the handle 140 and the door latch, and when the handle 140 is pulled, operating force of the handle 140 is transmitted to the door latch through the cable, thereby opening the door.

Hereinafter, an operating state of the handle will be described below with reference to FIG. 5.

FIG. 5 illustrates a state in which the handle 140 is stored so as not to protrude from the surface of the door panel 101, and in this stored state, the second pushing portion 122 of the driving member 120 prevents the driving arm 130 from being moved in the direction in which the handle 140 protrudes, and supports the driving arm 130 at the same time.

In particular, since the driving arm 130, the driving member 120, and the rotary gear 115 are not rotated but completely fixed before the motor 112 is operated, the handle 140 cannot protrude forcedly due to external force from the outside of the vehicle, such that the door cannot be opened by external force from the outside of the vehicle, and a door locked state may be implemented.

That is, the door locked state may be implemented only by the handle stored state.

The operation of the motor 112 is controlled by a non-illustrated controller. For example, in a case in which a driver manipulates a lock button of a remote control, in a case in which the driver having a smart key moves away from a vehicle to which a PIC system (or a smart key system) is applied, or in a case in which a button (not illustrated) provided on the handle 140 is pushed in a door unlocked state, the controller unit operates the motor 112 to store the handle 140 in the door panel 101 so that the handle 140 cannot be pulled.

On the contrary, in a case in which the driver manipulates an unlock button of the remote control, in a case in which the driver having the smart key approaches the vehicle within a predetermined distance, or in a case in which the driver having the smart key pushes the button of the handle 140 in the door locked state, the controller operates the motor 112 to allow the handle 140 to pop up toward the outside of the door panel 101 so that the handle 140 may be pulled.

The door unlocked state may be implemented only by the handle pop-up state.

A process in which the handle protrudes from the stored state illustrated in FIG. 5 to the pop-up state will be described. First, the controller operates the motor 112 in the forward direction, and rotational force of the motor 112 is transmitted to the driving member 120 through the worm gear 114 and the rotary gear 115.

In this case, the driving member 120 and the rotary gear 115 are rotated in the counterclockwise direction as illustrated in FIG. 5, and particularly, the driving member 120 and the rotary gear 115 are rotated so that the driving member 120 may push the driving arm 130, such that the first pushing portion 121 of the driving member 120 comes into contact with the driving arm 130.

Next, when the motor 112 continues to be operated, the first pushing portion 121 of the driving member 120 pushes and rotates the driving arm 130 in the counterclockwise direction in the drawing. In this case, the handle 140 protrudes toward the outside of the housing 150 and the door panel 101, and after the driving member 120 is rotated by a predetermined degree, the handle 140 completely pops up as illustrated in FIG. 5.

In this state, when the handle 140 is pulled, the handle 140 may be pulled by the interval between the first pushing portion 121 and the second pushing portion 122, and as illustrated in FIG. 5, when the handle 140 is pulled at an operation stroke corresponding to the interval, the cable is pulled together, such that the operation of opening the door is carried out by the door latch.

In addition, when the motor 112 is operated in the reverse direction in order to move the handle 140 from the handle pop-up position illustrated in FIG. 5 via the position in FIG. 5 to the position in FIG. 5 at which the handle 140 is completely stored, the worm gear 114, the rotary gear 115, the driving member 120, and the driving arm 130 are also rotated in the reverse direction, and as a result, the handle 140 is stored back into the door panel 101.

In this case, the handle 140 is obliquely moved into the housing 150 along the curved operation trajectory while the two driving arms 130 at both sides of the handle 140 are rotated at the same time. As described above, in a case in which the handle 140 is obliquely moved into the housing 150 from the upper side to the lower side, it is possible to reduce a size of a space for storing the handle 140, and to reduce a volume of the apparatus including the housing 150, thereby improving a degree of design freedom.

Meanwhile, FIG. 6 to FIG. 13C are views illustrating a retractable handle system according to various embodiments of the present invention.

Figure 6:
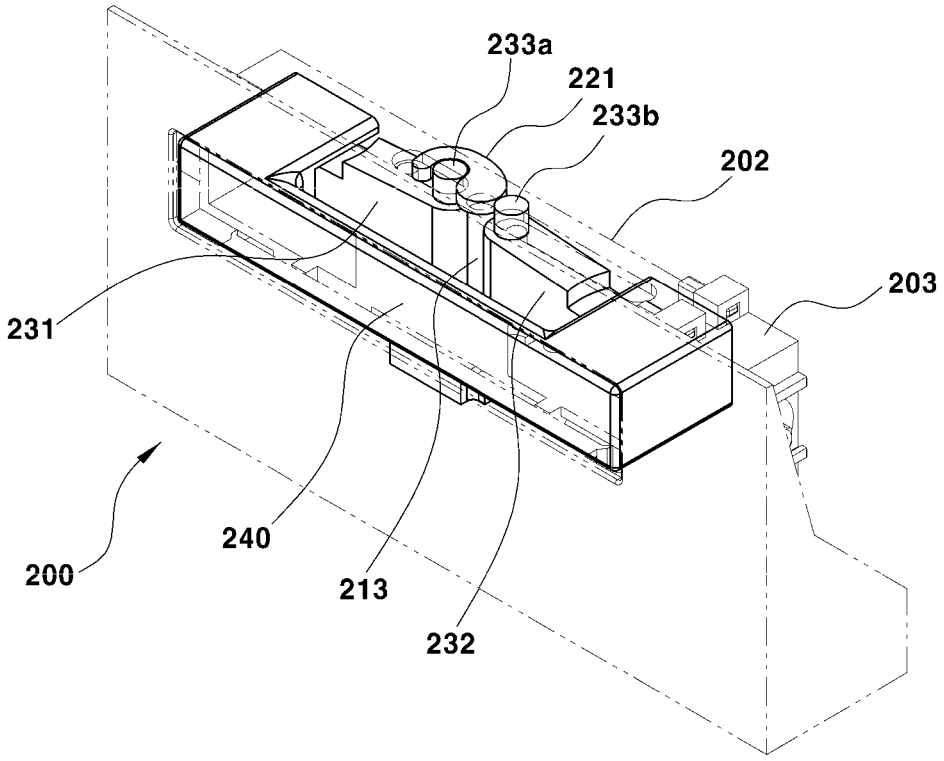
FIG. 6 and FIG. 7 are coupled perspective views illustrating a state in which a handle of an exemplary retractable handle system according to the present invention is stored.
Figure 7:
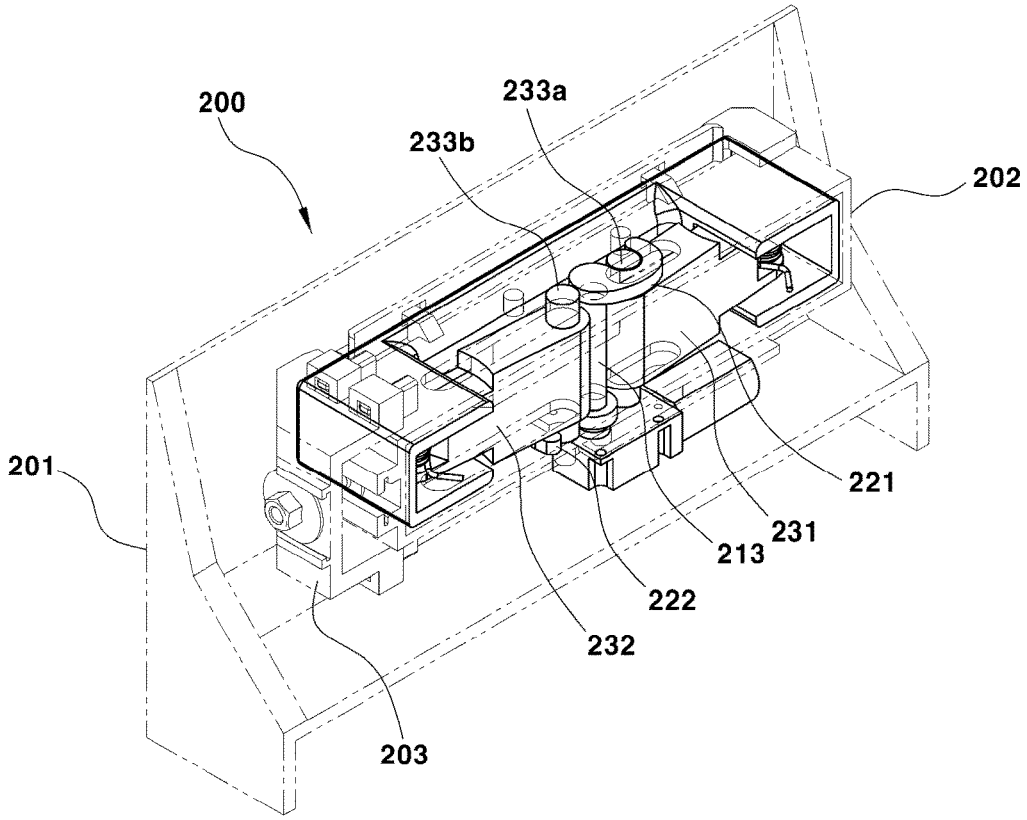
Figure 8:
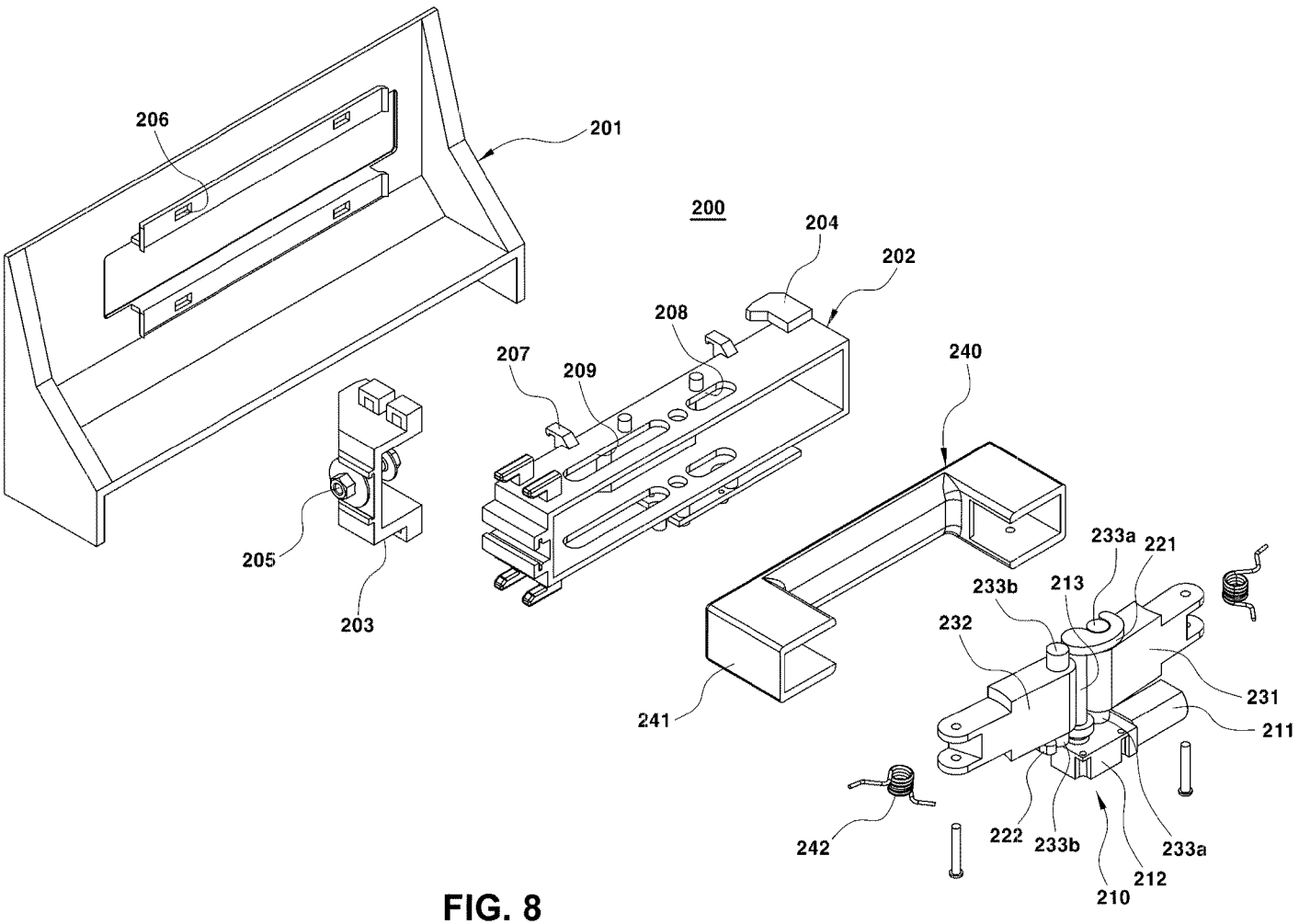
FIG. 8 and FIG. 9 are exploded perspective views of the exemplary retractable handle system of FIG. 6 and FIG. 7, according to the present invention.
Figure 9:
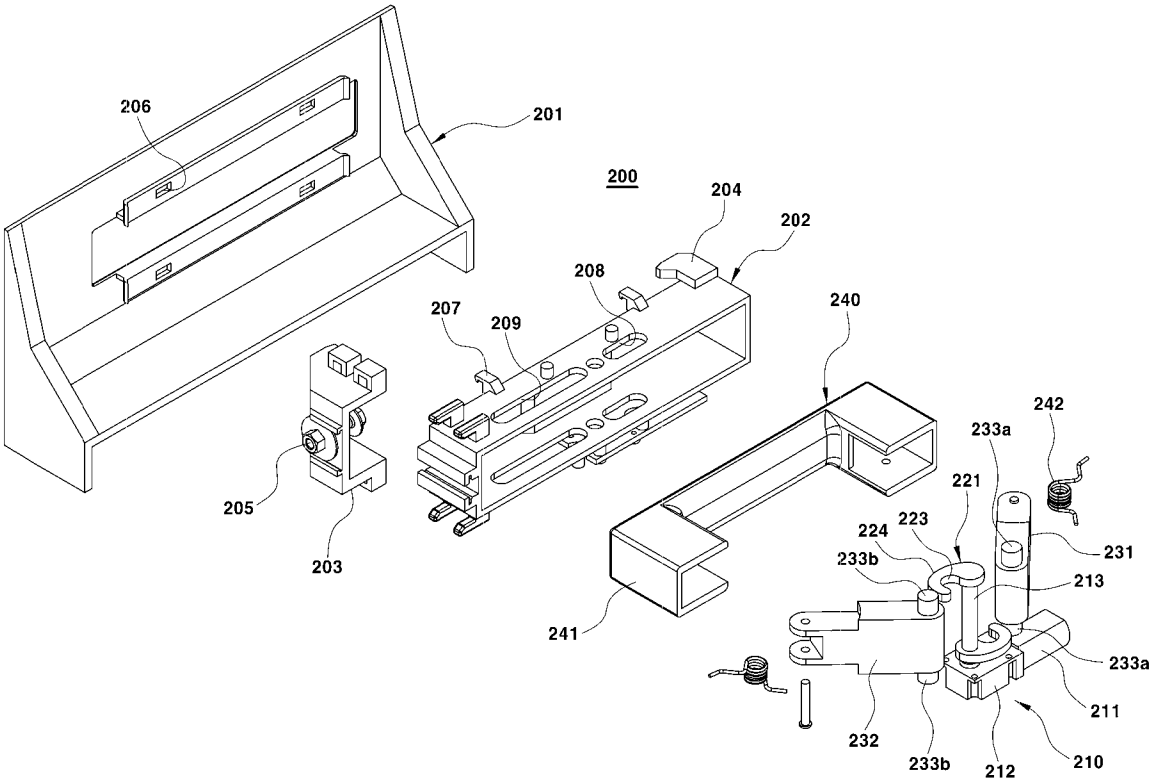
Figure 10:
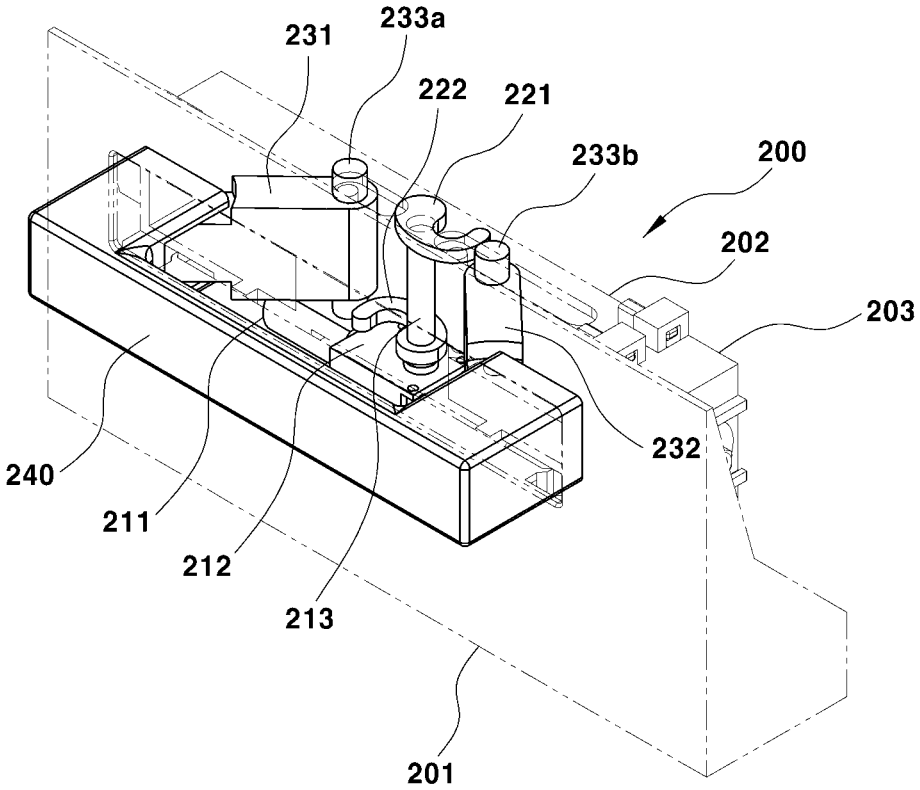
FIG. 10 and FIG. 11 are coupled perspective views illustrating a state in which the handle of the exemplary retractable handle system of FIG. 6 and FIG. 7, according to the present invention. pops up.
Figure 11:
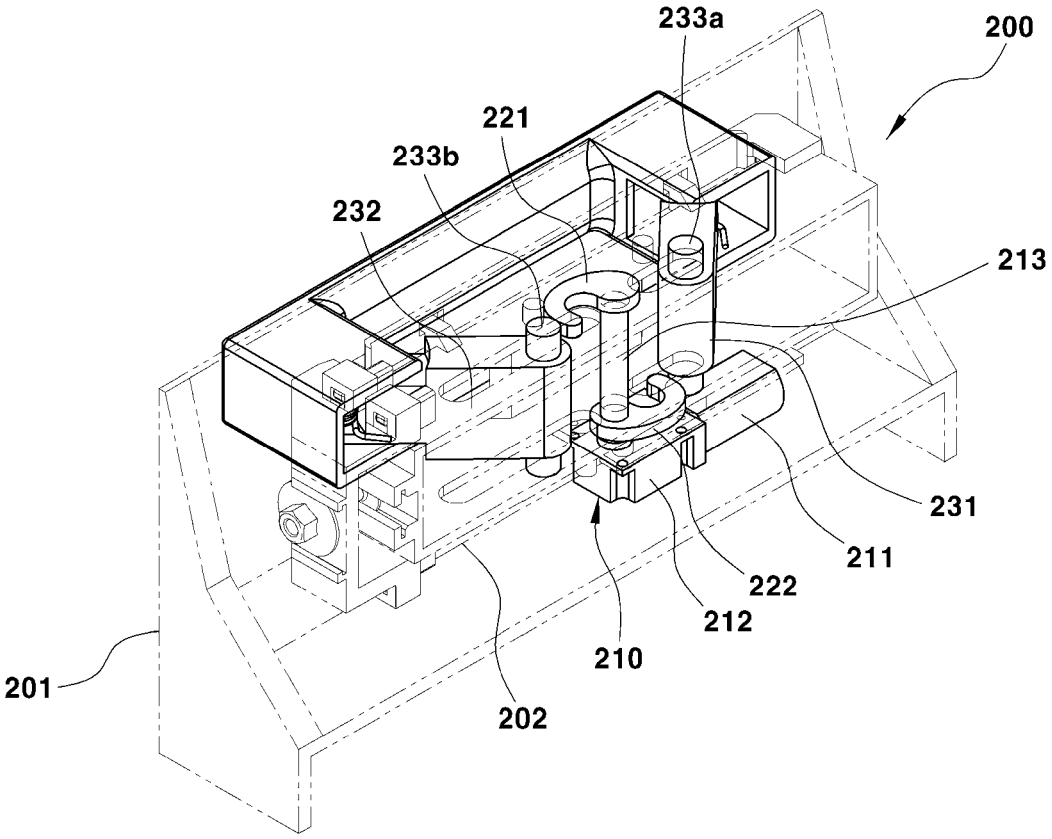

FIG. 6 and FIG. 7 are coupled perspective views illustrating the handle stored state (corresponding to the door locked state), FIG. 8 and FIG. 9 are exploded perspective views of the retractable handle system, and FIG. 10 and FIG. 11 are coupled perspective views illustrating the handle pop-up state (corresponding to the door unlocked state).

Figure 12A:
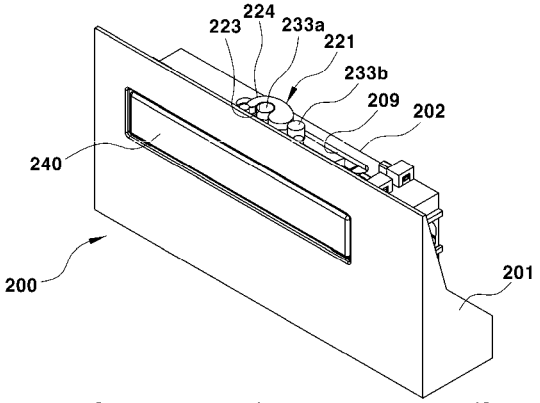
FIG. 12A, FIG. 12B, FIG. 12C, FIG. 13A, FIG. 13B, and FIG. 13C are views illustrating an operating state of the exemplary retractable handle system of FIG. 6 and FIG. 7, according to the present invention.
Figure 12B:
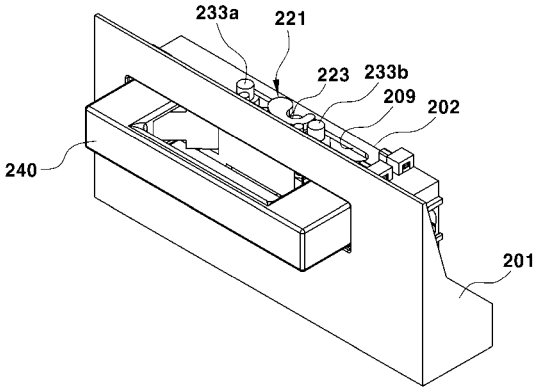
Figure 12C:
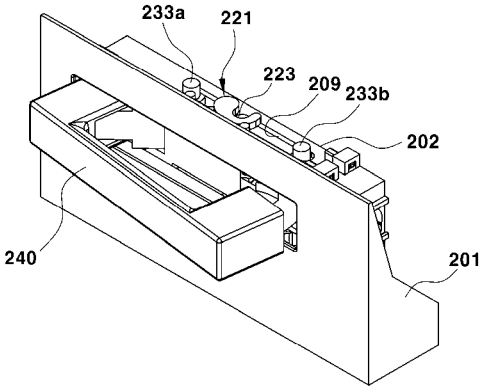
Figure 13A:
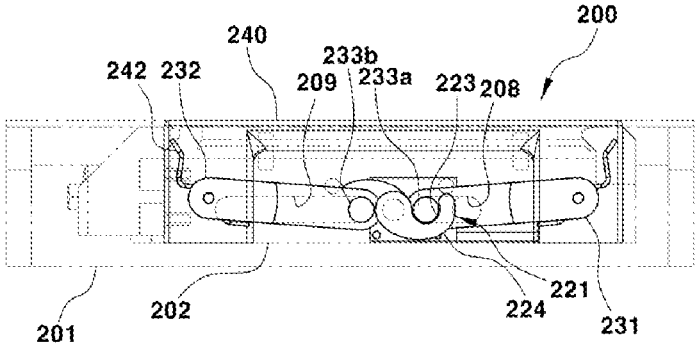
Figure 13B:
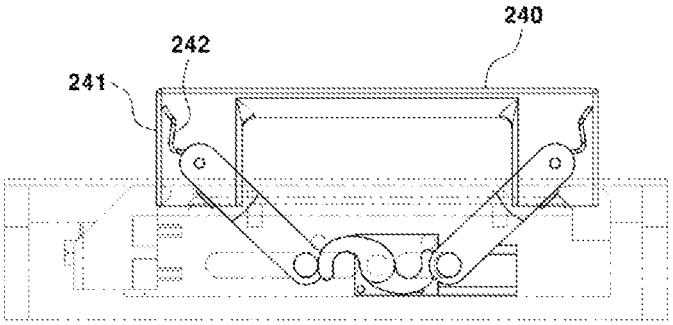
Figure 13C:
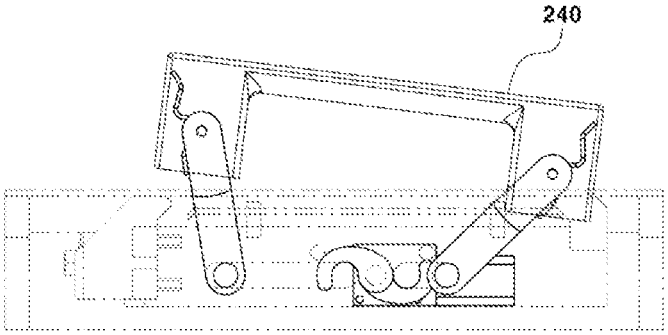

In addition, FIG. 12A, FIG. 12B, FIG. 12C, FIG. 13A, FIG. 13B, and FIG. 13C are views illustrating an operating state of the retractable handle system, in which FIG. 12A and FIG. 13A illustrate the handle stored state (door locked state), FIG. 12B and FIG. 13B illustrate the handle pop-up state (door unlocked state), and FIG. 12C and FIG. 13C illustrate a state in which the handle is additionally pulled from the pop-up state to open the door (a state in which the handle is manipulated to open the door).

Even in a retractable handle system 200 according to the various embodiments, a non-illustrated cable is connected between a handle 240 and a door latch, and when the handle 240, which has popped up, is additionally pulled, operating force of the handle is transmitted to the door latch through the cable that is pulled together with the handle, thereby opening the door.

While FIG. 12A, FIG. 12B, FIG. 12C, FIG. 13A, FIG. 13B, and FIG. 13C illustrate a state in which the handle 240 is pulled to be rotated in one direction to open the door, the cable may be pulled when both sides of the handle are pulled in parallel to open the door.

To this end, in the pop-up state of the handle 240, a first driving arm 231 and a second driving arm 232, which will be described below, need to be additionally rotated at the same degree at the same time, and two guide holes 208 and 209 at both sides of a support frame 202 to be described below need to have the same length in order to allow the first driving arm 231 and the second driving arm 232 to be additionally rotated at the same degree.

As illustrated, the retractable handle system of the various embodiments includes a main frame 201 which is fixed inside a door panel, and the support frame 202 which is disposed to be supported by the main frame 201 and has driving members 221 and 222, the driving arms 231 and 232, and the handle 240 disposed thereon.

The support frame 202 may be coupled to the main frame 201 in a way that protrusions 207 are fitted into and assembled to fitting holes 206 formed in the main frame 201. In addition, in a state in which the support frame 202 is coupled to the main frame 201 by the fitting holes 206 and the protrusions 207, a position and a posture of the support frame 202 may be completely fixed by a first fixing member 203 and a second fixing member 204, which are provided to be in close contact with and supported by the main frame 201, in order to prevent the support frame 202 from being moved in the main frame 201 in up, down, left and right directions.

Here, the first fixing member 203 is a member that has one side which is supported by an inner surface of the main frame 201, and the other side which is coupled to the support frame 202 by a fastening bolt 205, and thus supports the support frame 202 on the main frame 201. The second fixing member 204 is a member that is formed integrally with the support frame 202, and supports the support frame 202 on the main frame 201 in a state in which one side of the second fixing member 204 is coupled to the main frame 201.

In addition, the first driving arm 231 and the second driving arm 232, which are rotated in opposite directions by rotations of the driving members 221 and 222, are disposed in an internal space in the support frame 202, and the first driving member 221 and the second driving member 222, which are rotated by receiving rotational force of the electric actuator 210, are disposed on outer surfaces of upper and lower portions of the support frame 202, respectively.

In addition, the electric actuator 210 is provided to rotate the first driving member 221 and the second driving member 222 at the same time in the direction in which the handle is stored and in the direction in which the handle pops up, and may be disposed to cross the main frame 201 and the support frame 202.

The electric actuator 210 includes a motor 211 which is fixedly disposed inside the door panel, particularly, on the main frame 201 or the support frame 202 inside the door panel, a gear device 212 which transmits rotational force of the motor 211 to a driving shaft 213, and the driving shaft 213 which transmits rotational force of the motor 211, which is output from the gear device 212, to the driving members 221 and 222 to rotate the driving members in the direction in which the handle is stored or in the direction in which the handle pops up.

In this case, the driving shaft 213, which transmits rotational force of the motor 211 which is output from the gear device 212, is coupled to the support frame 202 and disposed to be elongated in an up and down direction, and upper and lower ends of the driving shaft 213 are integrally coupled to the first driving member 221 at the upper side and the second driving member 222 at the lower side.

Therefore, rotational force of the motor 211 may be transmitted to the driving members 221 and 222 through the gear device 212 and the driving shaft 213, such that when the electric actuator 210 is operated, particularly, when the motor 211 is operated, the driving members 221 and 222 may be rotated at the same time by the rotational force that is transmitted through the gear device 212 and the driving shaft 213.

In addition, the first driving arm 231 and the second driving arm 232 are rotatably disposed at both left and right sides of the support frame 202, respectively. One end of each of the driving arms 231 and 232 is hingedly coupled the handle 240 that is stored and pops up.

The driving arms 231 and 232 are rotated at the same time in a direction toward the outside of the support frame 202 and deployed to the outside of the door panel while being pushed by cam surfaces 224 of the driving members when the driving members 221 and 222 are rotated, thereby pushing the handle 240 in the direction in which the handle 240 pops up.

In contrast, when the driving members 221 and 222 do not push the driving arms 231 and 232, the driving arms 231 and 232 are rotated at the same time in the reverse direction, that is, in a direction toward the inside of the door panel, and retracted toward the inside of the support frame 202, thereby pulling the handle 240 so that the handle 240 is stored.

To this end, one end of the each of the driving arms 231 and 232 is hingedly coupled to each bridge portion 241 of the handle 240, and a spring member 242, which provides elastic restoring force for rotating each of the driving arms 231 and 232 with respect to the handle 240 in a direction in which each of the driving arms 231 and 232 are retracted, is disposed between one end of each of the driving arms 231 and 232 and the handle 240.

When the driving arms 231 and 232 are rotated with respect to the handle 240 by elastic restoring force of the spring members 242 in the direction in which the driving arms 231 and 232 are retracted, the bridge portions 241 of the handle 240 are inserted into the support frame 202, and at the same time, the entire handle 240 is drawn into the door panel, such that the handle 240 is placed in the handle stored state in which the handle 240 does not protrude toward the outside of the door panel.

In addition, the other end of the driving arms 231 and 232 is coupled to guide holes 208 and 209 formed in the support frame 202 by protrusions 233*a* and 233*b*, and the other end of the driving arms 231 and 232 is coupled to the support frame 202 by the protrusions 233*a* and 233*b* and the guide holes 208 and 209.

The protrusions 233*a* and 233*b* of the driving arms 231 and 232, which are moved along and guided by the guide holes 208 and 209, are rotation centers of the driving arms 231 and 232 that are rotated when the handle pops up and when the handle is stored.

In addition, when describing a shape of the driving members, the first driving member 221 and the second driving member 222 have a hook shape that may catch the protrusions 233*a* and 233*b* of the driving arm 231 at one side and the driving arm 232 at the other side in the handle stored state. In the handle stored state, the protrusions 233*a* and 233*b* of the driving arms 231 and 232 are inserted into catching grooves 223 of the driving members 221 and 222, and when the protrusions are caught by the driving members, the driving arms are not rotated, and the handle is maintained in the stored state, such that the door is placed in the locked state in which the handle is not moved in the direction in which the handle pops up.

In this case, the two driving members 221 and 222 at both left and right sides lock the driving arms 231 and 232, respectively, through the protrusions 233*a* and 233*b* of the driving arms. As described above, when the driving arms 231 and 232 are locked by the driving members 221 and 222 in the state in which the handle 240 is stored, the handle 240 cannot be used at the outside, thereby implementing the function of locking the door.

When the electric actuator 210 rotates the first driving member 221 and the second driving member 222 at the same time in the direction in which the handle is stored, the protrusion 233*a* of the first driving arm 231 is inserted into the catching groove 223 of the first driving member 221, whereby the first driving member 221 locks the first driving arm 231.

In addition, the protrusion 233*b* of the second driving arm 232 is inserted into the catching groove 223 of the second driving member 222, whereby the second driving member 222 locks the second driving arm 232.

As a result, when the electric actuator 210 rotates the driving shaft 213 and the driving members 221 and 222 in the direction in which the handle is stored, and the driving arms 231 and 232 are rotated by elastic restoring force of the spring members 242 in the direction in which the handle is stored, the driving members 221 and 222 catch the protrusions 233*a* and 233*b* of the driving arms 231 and 232, respectively, to lock the driving arms, and in this case, the driving members 221 and 222 hold the driving arms 231 and 232, such that the handle 240 cannot pop up.

Therefore, when the handle 240 is completely placed in the stored state in which the handle 240 does not protrude toward the outside of the door panel, the door is placed in the door locked state in which the door cannot be arbitrarily opened at the outside.

In contrast, when the electric actuator 210 rotates the driving shaft 213 and the driving members 221 and 222 in the direction in which the handle pops up, the driving member 221 or 222 is separated from the protrusion 233*a* and 233*b* of one driving arm 231 or 232 locked by the driving member while being rotated at the same time, and then the cam surface 224 of the driving member 221 or 222 pushes the protrusion 233*a* or 233*b* of the other driving arm 231 or 232 opposite to the one driving arm 231 or 232, thereby rotating the other driving arm 231 or 232.

In this case, when the driving members 221 and 222 push the driving arms 231 and 232 through the protrusions 233*a* and 233*b*, the driving arms 231 and 232 are rotated at the same time to be deployed to the outside of the support frame 202 and the door panel, and as the driving arms 231 and 232 at both sides are rotated and deployed to the outside at the same time as described above, the handle 240 pops up while being pushed to the outside.

In this case, the protrusions 233*a* and 233*b* of the driving arms 231 and 232 are guided along the guide holes 208 and 209 of the support frame 202.

In addition, since the handle 240 needs to be additionally pulled to open the door in the handle pop-up state, the guide hole 209, which guides the protrusion 233*b* of the driving arm 232 that is rotated when the handle 240 is additionally pulled, needs to be longer the guide hole 208 so that the protrusion 233*b* may be additionally moved in the handle pop-up state.

That is, referring to the illustrated drawings, in a case in which the handle 240 is pulled to be rotated in one direction to open the door, the second driving arm 232 is additionally rotated from a position when the handle 240 pops up, and as a result, the guide hole 209, which guides the protrusion 233*b* of the second driving arm 232, needs to be longer than the guide hole 208 that guides the protrusion 233*a* of the first driving arm 231.

In a case in which the handle 240 is not rotated in any one direction, but the handle is pulled so that both of the bridge portions 241 are drawn to the outside of the support frame 202 at the same time to open the door, that is, in a case in which both sides of the handle 240 are pulled and moved in parallel, the guide holes 208 and 209 at both sides of the support frame 202, which guide the protrusion 233*a* of the first driving arm 231 and the protrusion 233*b* of the second driving arm 232, need to have the same length. In this case, the guide holes 208 and 209 need to be formed to have the length along which the protrusions 233*a* and 233*b* of the driving arms 231 and 232 may be additionally moved from the handle pop-up state up to the position at which the door is opened.

Hereinafter, an operating state of the retractable handle system will be described with reference to FIG. 12A, FIG. 12B, FIG. 12C, FIG. 13A, FIG. 13B, and FIG. 13C.

FIG. 12A and FIG. 13A illustrate a state in which the handle 240 is completely stored so as not to protrude from the surface of the door panel. In this handle stored state, the driving members 221 and 222 catch the protrusions 233*a* and 233*b* of the driving arms 231 and 232, the driving arms 231 and 232 are blocked from being rotated.

In particular, since the driving members 221 and 222 and the driving arms 231 and 232 are not rotated but completely fixed before the motor 211 is operated, the handle 240 cannot protrude forcedly due to external force from the outside of the vehicle, such that the door cannot be opened by external force from the outside of the vehicle, and the door locked state may be implemented.

That is, the door locked state may be implemented only by the handle stored state.

The operation of the motor 211 is controlled by a non-illustrated controller. For example, in a case in which a driver manipulates a lock button of a remote control, in a case in which a driver having a smart key moves away from a vehicle to which a PIC system (or a smart key system) is applied, or in a case in which a button (not illustrated) provided on the handle 240 is pushed in a door unlocked state, the controller operates the motor 211 to store the handle 240 in the door panel so that the handle 240 cannot be pulled.

On the contrary, in a case in which the driver manipulates an unlock button of the remote control, in a case in which the driver having the smart key approaches the vehicle within a predetermined distance, or in a case in which the driver having the smart key pushes the button of the handle 240 in the door locked state, the controller operates the motor 211 to allow the handle 240 to pop up toward the outside of the door panel so that the handle 240 may be pulled.

The door unlocked state may be implemented only by the handle pop-up state.

A process in which the handle protrudes from the state illustrated in FIG. 12A and FIG. 13A to the pop-up state will be described. First, the controller operates the motor 211 of the electric actuator 210 in the forward direction, and rotational force of the motor 211 is transmitted to the driving members 221 and 222 through the gear device 212 and the driving shaft 213.

In this case, the driving member 221 or 222 is separated from the protrusion 233*a* or 233*b* of one driving arm 231 or 232 while being rotated, and one driving arm 231 or 232 is unlocked. Further, the cam surface 224 of the driving member 221 or 222 pushes the protrusion 233*a* or 233*b* of the other driving arm 231 or 232 so that the protrusion 233*a* or 233*b* is moved along the guide hole 208 or 209.

Therefore, the driving arms 231 and 232 are rotated to be deployed and protrude toward the outside of the support frame 202 and the door panel at the same time, and in this case, the handle 240 supported by the driving arms 231 and 232 is moved to the outside of the door panel, thereby implementing the handle pop-up state as illustrated in FIG. 12B and FIG. 13B.

In this handle pop-up state, when the handle 240 is additionally pulled as illustrated in FIG. 12C and FIG. 13C, the door is opened.

When describing a process in which the handle 240 is stored, the controller operates the motor 211 of the electric actuator 210 in the reverse direction in the state illustrated in FIG. 12B and FIG. 13B, and rotational force of the motor 211 is transmitted to the driving members 221 and 222 through the gear device 212 and the driving shaft 213.

In this case, the driving members 221 and 222 are rotated by the driving shaft 213 in a direction reverse to the direction in which the handle pops up, and the driving arms 231 and 232 supported by the cam surfaces 224 of the driving members 221 and 222 are rotated by elastic restoring force of the spring members 242 in the reverse direction.

That is, the driving arms 231 and 232 are rotated and moved into the support frame 202, and in this case, the handle 240 is stored inside the door panel by being pulled by the driving arms 231 and 232 that are being rotated, and the protrusions 233*a* and 233*b* of the driving arms 231 and 232 are moved to ends of the guide holes 208 and 209, that is, the original positions.

As a result, the driving members 221 and 222, which are being rotated by the driving shaft 213, catch the protrusions 233*a* and 233*b* of the driving arms 231 and 232 again, and in this case, the protrusions 233*a* and 233*b* of the driving arms 231 and 232 are inserted into the catching grooves 223 of the driving members 221 and 222.

Accordingly, the driving members 221 and 222 lock the driving arms 231 and 232 again, thereby preventing the handle 240 from popping up forcedly in the stored state.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A retractable handle system for a vehicle, comprising:
an electric actuator disposed inside a door panel;
a driving member configured to be rotated in forward and reverse directions by receiving rotational force of the electric actuator;
a driving arm provided to be rotated in the forward and reverse directions by the rotation of the driving member and blocked by the driving member from being rotated in a state in which an operation of the electric actuator is stopped so as to maintain a stored state and a pop-up state of a handle; and
the handle which is supported by and coupled to the driving arm and configured to be moved by the forward and reverse rotations of the driving arm so as to be placed in the stored state in which the handle is retracted into the door panel in order to lock a door, or in the pop-up state in which the handle protrudes toward an outside of the door panel in order to enable an operation of opening the door,
wherein the electric actuator, the driving member, the driving arm, and the handle are disposed in a housing that is fixedly mounted inside the door panel, and as a guide device that allows the handle to be guided in the housing along an operation trajectory, a protrusion, which protrudes from the handle, and a guide groove, which is formed in the housing to allow the protrusion to be inserted into and guided by the guide groove, are provided.

2. The retractable handle system of claim 1, wherein the electric actuator includes rotation prevention mechanism that prevents the driving member from rotating when the operation of the electric actuator is stopped in the handle stored state.

3. The retractable handle system of claim 2, wherein the electric actuator includes:
a case;
a motor which is mounted in the case; and
a gear device to transmit rotational force of the motor to the driving member.

4. The retractable handle system of claim 3, wherein the electric actuator includes a gear device that serves as a rotation prevention mechanism which prevents the driving member from rotating when the operation of the electric actuator is stopped in the handle stored state, the gear device including a worm gear which is disposed on a driving shaft of the motor, and a rotary gear which is rotatably and integrally coupled to the driving member and engages, in the form of a worm wheel, with the worm gear.

5. The retractable handle system of claim 1, wherein two driving arms are provided, one on each of left and right sides so as to support the handle at both of the left and right sides, a first end of each of the driving arms is coupled to the handle, and a second end of each of the driving arms is coupled to the driving member so as to be operated in conjunction with the driving member.

6. The retractable handle system of claim 5, wherein the electric actuator, the driving member, the driving anus, and the handle are disposed in the housing that is fixedly mounted inside the door panel, a hinge shaft is connected between the second ends of the two driving arms at both left and right sides, and both ends of the hinge shaft are rotatably coupled to the housing in a state in which the hinge shaft penetrates a rotation center of the driving member.

7. The retractable handle system of claim 6, wherein an end of at least one of the two driving arms is coupled to be positioned inside the driving member, and the driving member includes:
a first pushing portion configured to push the driving arm positioned inside the driving member when the driving member is rotated in a direction in which the handle pops up; and
a second pushing portion configured to push the driving arm positioned inside the driving member when the driving member is rotated in a direction in which the handle is stored.

8. The retractable handle system of claim 7, wherein an interval is formed between the first pushing portion and the second pushing portion, where the end of the driving arm is positioned, so that the driving arm being in contact with the first pushing portion is rotated toward the second pushing portion in order to allow the handle to be additionally pulled to open the door in the pop-up state in which the handle protrudes from a surface of the door panel.

9. The retractable handle system of claim 1, wherein the electric actuator includes:
a case;
a motor which is mounted in the case; and
a gear device to transmit rotational force of the motor to the driving member.

10. A retractable handle system for a vehicle, comprising:

an electric actuator disposed inside a door panel;

driving members configured to be rotated in forward and reverse directions by receiving rotational force of the electric actuator;

a driving arm provided to be rotated in the forward and reverse directions by the rotation of the driving members and blocked by the driving members from being rotated in a state in which an operation of the electric actuator is stopped so as to maintain a stored state and a pop-up state of a handle, the handle which is supported by and coupled to the driving arm and configured to be moved by the forward and reverse rotations of the driving arm so as to be placed in the stored state in which the handle is retracted into the door panel in order to lock a door, or in the pop-up state in which the handle protrudes toward an outside of the door panel in order to enable an operation of opening the door; and a support frame which is fixedly disposed inside the door panel, wherein the driving arm includes a first driving arm and a second driving arm that are disposed at both left and right sides of the support frame, and a first end of each of the first driving arm and the second driving arm is hingedly coupled to the handle, and a second end thereof is coupled to guide holes of the support frame through protrusions, wherein the electric actuator includes:

a motor;

a gear device which transmits rotational force of the motor; and a driving shaft connected to the driving members to transmit rotational force of the motor, which is output from the gear device, to the driving members, and wherein the driving members include a first driving member and a second driving member, and the first driving member and the second driving member are formed to have hook shapes that hook the protrusions of the first and second driving arms when the protrusions of the first and second driving arms are inserted into catching grooves, and catch the protrusions of the first and second driving arms, respectively, in the handle stored state to restrict the corresponding driving arm among the first and second driving arms and block the corresponding driving arm from being rotated so that the handle does not pop up.

11. The retractable handle system of claim 10, wherein the first driving arm and the second driving arm are configured to be rotated about the protrusions that are moved and guided along the guide holes of the support frame, and rotated to be deployed and protrude toward the outside of the support frame and the door panel so as to push the handle when the handle pops up.

12. The retractable handle system of claim 10, wherein a spring member, which provides elastic restoring force for rotating each of the first driving aim and the second driving arm with respect to the handle so that each of the first driving arm and the second driving arm is retracted into the support frame when the handle is stored, is disposed between the first end of each of the first driving arm and the second driving arm and the handle.

13. The retractable handle system of claim 10, wherein each of the first driving member and the second driving member includes a cam surface that is separated from the protrusion of one driving aim among the first and second driving arms and is configured to push the protrusion of another driving arm among the first and second driving arms when the first driving member and the second driving member are rotated in a direction in which the handle pops up so as to allow the protrusion of the other driving arm to be moved along the guide hole of the support frame and rotate the other driving arm in the direction in which the handle pops up.

* * * * *